US005387849A

United States Patent [19]

Sridharan

[11] Patent Number: 5,387,849

[45] Date of Patent: Feb. 7, 1995

[54] LAMP BALLAST SYSTEM CHARACTERIZED BY A POWER FACTOR CORRECTION OF GREATER THAN OR EQUAL TO 90%

[75] Inventor: Sri Sridharan, Hickory Hills, Ill.

[73] Assignee: Radionic Technology Incorporated, Chicago, Ill.

[21] Appl. No.: 990,283

[22] Filed: Dec. 14, 1992

[51] Int. Cl.[6] ..... H05B 41/04; H05B 41/18

[52] U.S. Cl. ..... 315/247; 315/99; 315/101; 315/103; 315/243; 315/245; 315/290; 315/DIG. 5

[58] Field of Search ..... 315/247, 290, 241, 242, 315/243, 244, 245, 98–106, DIG. 5

[56] References Cited

U.S. PATENT DOCUMENTS

| | | | |
|---|---|---|---|
| 2,268,512 | 12/1941 | McCarthy | 315/247 X |
| 3,465,204 | 7/1967 | Michalski | 315/363 |
| 3,569,776 | 3/1971 | Moerkens et al. | 315/102 |
| 3,588,599 | 6/1971 | Michalski | 315/209 |
| 3,659,150 | 4/1972 | Laupman | 315/106 |
| 3,665,243 | 5/1972 | Kaneda et al. | 315/241 R X |
| 3,700,962 | 10/1972 | Munson | 315/241 |
| 3,705,329 | 12/1972 | Vogeli | 315/103 |
| 3,836,817 | 9/1974 | Tchang et al. | 315/100 |
| 3,886,405 | 5/1975 | Kubo | 315/246 |
| 3,889,152 | 6/1975 | Bodine, Jr. et al. | 315/205 |
| 3,925,705 | 12/1975 | Elms et al. | 315/246 |
| 3,976,910 | 8/1976 | Owens et al. | 315/92 |
| 3,986,076 | 10/1976 | Rottier | 315/244 X |
| 4,015,167 | 3/1977 | Samuels | 315/99 |
| 4,032,817 | 6/1977 | Richmond | 315/149 |
| 4,181,872 | 1/1980 | Chermin | 315/106 |
| 4,288,725 | 9/1981 | Morton | 315/245 |
| 4,399,390 | 8/1983 | Oshita et al. | 315/101 |
| 4,442,380 | 4/1984 | Adachi | 315/101 |
| 4,460,848 | 7/1984 | Fahnrich | 315/101 |
| 4,473,778 | 9/1984 | Adachi | 315/101 |
| 4,847,535 | 7/1989 | Wisbey et al. | 315/101 |
| 4,914,354 | 4/1990 | Hammer et al. | 315/247 |
| 5,023,521 | 6/1991 | Sridharan | 315/290 |
| 5,072,156 | 12/1991 | Droho | 315/247 X |
| 5,175,469 | 12/1992 | Droho | 315/247 X |
| 5,289,084 | 2/1994 | Nuckolls et al. | 315/247 |

OTHER PUBLICATIONS

Affidavit of Richard G. Norris dated Jul. 29, 1992 with attached exhibits, of which Exhibit 1 is a photocopy of a document titled "TECCOR NEWS—THYRISTORS FOR IGNITION OF FLUORESCENT LAMPS" and allegedly published in the Dec., 1982 to Jan., 1983 time frame.

*Primary Examiner*—David Mis

*Attorney, Agent, or Firm*—Hill, Steadman & Simpson

[57] ABSTRACT

A ballast circuit for a fluorescent lamp including a magnetic choke electrically connected between the lamp and a power supply and an electronic starter circuit electrically coupled across said lamp, which ballast circuit is configured to provide a power factor of at least 90%. To this end, for certain lamps a power factor correcting capacitance is electrically connected across the power supply. For other lamps, a power factor correcting resistance is coupled between the ballasting capacitance and inductor so that the inductor and ballasting capacitance close to resonance.

27 Claims, 2 Drawing Sheets

LAMP BALLAST SYSTEM CHARACTERIZED BY A POWER FACTOR CORRECTION OF GREATER THAN OR EQUAL TO 90%

BACKGROUND OF THE INVENTION

The present invention relates generally to ballast circuits for fluorescent lights, and, particularly, to ballast circuits for a fluorescent lamp including a magnetic choke and an electronic starter circuit.

In the lighting of fluorescent lamps, a gas enclosed within a glass tube is caused to become ionized, thus reducing a breakdown voltage between electrodes placed at opposite ends of the glass tube. Ionization is initiated by heating of the electrodes. Once the gas is sufficiently ionized, a voltage at or above the breakdown voltage is placed across the lamp electrodes to thereby cause a current arc to form across the electrodes. The arc produces a bright glow within the lamp tube and produces radiation that activates a fluorescent coating on the inner surface of the glass tube, to thereby produce a bright light.

In controlling the turning on and off of fluorescent lamps, it is necessary to control the current to the lamp and to provide a starting voltage. In fluorescent lamps, this task is performed by a circuit called a ballast, also referred to as a ballasting circuit. There are generally two types of ballasts: magnetic ballasts and electronic ballasts.

Presently, most low wattage fluorescent lamps utilize magnetic ballasts that include magnetic chokes or suitable magnetic transformers and glow bulb starters. The magnetic choke limits current flow to the lamp while the glow bulb starter creates a voltage spike across the lamp after sufficiently preheating the electrodes. These magnetic ballasts are considered inefficient because of considerable power dissipation in the magnetic components. Moreover, these ballasts exhibit low power factors because of the highly inductive reactances of the magnetic chokes. The power factor is the ratio of the average (or active) power to the apparent power (root-mean-square [rms] voltages times rms current) of an alternating circuit.

Further, the glow bulbs associated with these ballasts exhibit random starting times that produce unpleasant flashes as an arc attempts to be established across the electrodes of the lamp. This is especially true at low line voltages because the ballasts permit too much voltage to be applied to the bulbs, due to the inadequacies in the ballast design. Arcs are then produced across the bimetal components of the bulbs as the voltage will be nearly high enough to sustain arcing, and annoying flickering and restriking occurs. As a result, the performances of glow bulbs are not predictable and this results in unreliable starting times of the fluorescent lamps.

Electronic ballasts are very expensive and can suffer from poor reliability due to the larger number of components involved. In these ballasts, a variety of electronic components are utilized to heat up the electrodes of the lamp and to establish the breakdown voltage across the electrodes. A most undesirable effect associated with these ballasts is the generation of annoying electromagnetic waves by the circuits due to high frequency typically greater than or equal to 20 KHz chopping of the alternating current power signal. These electromagnetic waves can interfere with the operation of appliances such as T.V.'s and radios.

Magnetic ballasts have reliability problems after 6,000 cycles because of contact wear-out in the associated glow bulb starters therewith. Electronic ballasts suffer from similar reliability problems because of the larger number of discrete components used.

U.S. Pat. No. 5,023,521 describes a hybrid ballast circuit for low wattage lamps. In this circuit, a magnetic choke is directly connected between a power supply and one electrode of the lamp to be lit. An electronic starter circuit is across the lamp to provide preheating and starting voltages. This circuit, however, enjoys only a moderate power factor of about 80%, for F13T5 type lamps, i.e., 13 watt lamps.

SUMMARY OF THE INVENTION

The present invention provides an improved ballast system for fluorescent lamps that can be operated almost indefinitely and that overcomes the disadvantages of glow bulb starters and electronic starters and provides a high power factor of at least 90%. To this end, there is provided a hybrid ballast circuit including a magnetic choke and an electronic starter circuit. The hybrid ballast circuit utilizes magnetic inductive components connected in series with the lamp to approximately provide the required ballasting current for a fluorescent lamp. Further, an electronic starter circuit electrically connected across electrodes of the lamp momentarily heats the electrodes of the lamp and then provides a voltage spike sufficient to cause arcing across the electrodes before being effectively removed from the ballasting circuit. An appropriate power factor element is disposed to provide a power factor of 90% or greater.

In an embodiment, the invention provides a ballast circuit for a fluorescent lamp comprising:

- an inductance that is electrically connected between a power supply and the lamp;
- a ballasting capacitor that is electrically connected between the power supply and the lamp;
- an electronic starter electronically connected across the lamp; and
- a power factor correcting capacitor connected across the power supply, which capacitance provides a power factor of 90% or greater which is defined herein as high power factor.

In an embodiment, the invention provides that the inductance is a magnetic choke.

In an embodiment, the invention provides that the ballasting capacitor is a capacitor electrically connected between a terminal of the lamp and the power supply.

In an embodiment, the invention provides that the lamp is a four watt lamp.

In an embodiment, the invention provides that the lamp is an eight watt lamp.

In an embodiment, the invention provides that the lamp is a thirteen watt lamp.

In an embodiment, the invention provides that the power factor correcting capacitor is a 4 $\mu$F capacitor.

In an embodiment, the invention provides that the power factor correcting capacitance is a 2.8 $\mu$F capacitor.

In an embodiment, the invention provides that the electronic starter includes a triac triggered by a diac.

In an embodiment, the invention provides that the starter circuit includes a snubber circuit electrically connected across the lamp to prevent latch-up of the starter circuit.

In an embodiment, the invention provides:

- a thirteen watt fluorescent lamp coupled to a power supply;
- an electronic starter circuit electrically connected across the lamp, which electronic starter is effective to provide preheat current and starting voltage to the lamp; and
- a magnetic choke, a resistor and a capacitor connected in series between the power supply and the lamp, the choke, resistor and capacitor configured to provide a power factor of 90% or greater in combination with the thirteen watt lamp.

These and other features of the invention will become clearer in the following detailed description of the presently preferred embodiments with reference to the accompanying drawings.

DETAILED DESCRIPTION OF THE PREFERRED EMBODIMENT

Figure 1:
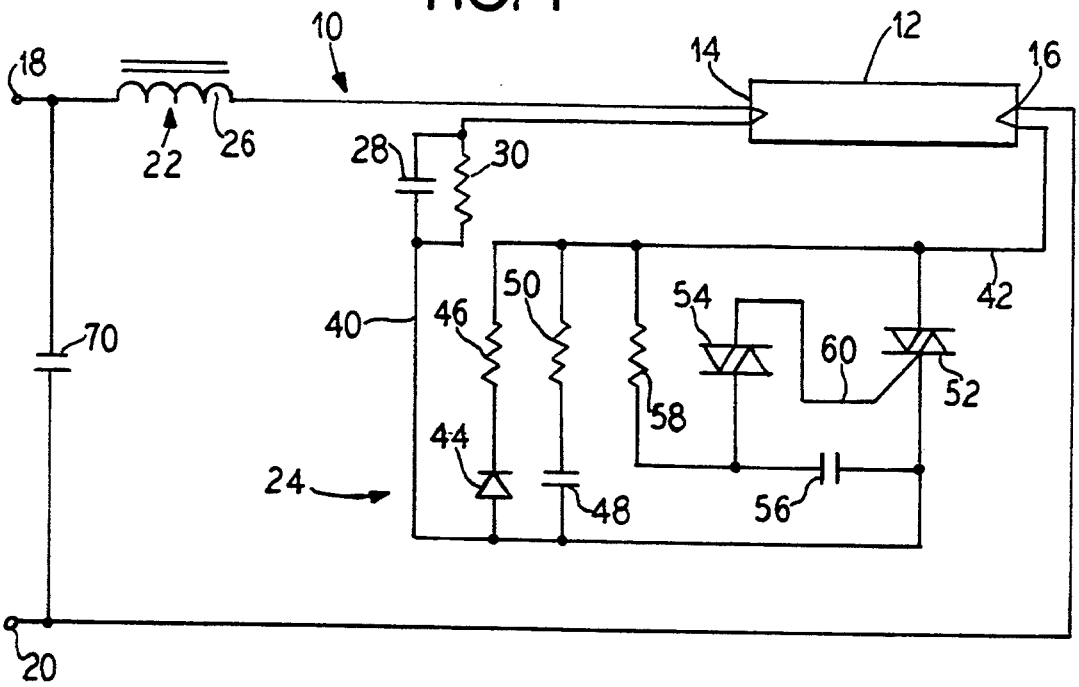
FIG. 1 illustrates a circuit diagram of a first ballasting circuit for fluorescent lamps having high power factor correction.

In FIG. 1 there is illustrated a ballasting circuit 10 embodying principles of the invention. The circuit 10 is electrically connected to and associated with a fluorescent lamp 12 having electrodes or filaments 14 and 16 to provide both current limitation to the lamp 12 and the required starting voltage. This circuit is high power factor corrected.

As illustrated, the circuit 10 includes terminals 18 and 20 to which is operatively switched an incoming alternating current power source suitable for operating the lamp 12. The circuit 10 further includes a magnetic choke 22 and an electronic starter circuit 24, the descriptions of which follow.

The magnetic choke 22 preferably is an inductor 26 electrically connected between the electrode 14 of the lamp 12 and the terminal 18. As can be appreciated, inductor 26 prevents any rapid change in the flow of current to the lamp 12 from the power source.

As further illustrated a ballasting capacitor 28 which determines the level of current through the circuit 10 is electrically connected between the anode of diode 44 through lead 40 and electrode 14. A resistor 30 coupled across the capacitor 28 acts as a bleeder resistor to discharge any charge stored in the capacitor 28 to reduce the voltage of the capacitor 28 to a safe value when the power supply is abruptly turned off or switched off. The value of the resistor 30 preferably is very high such as 470K ohms, so as to not provide a suitable alternative current path to the capacitor 28 when the circuit 10 is turned on.

Thus, it can be appreciated that the inductive and capacitive reactances provided by the inductor 26 and capacitor 28, respectively, provide the necessary ballasting impedance to limit the current to the desired level for the fluorescent lamp 12.

In the design of the inductor 26, several parameters are important in the provision of appropriate electrical characteristics required thereof for the circuit 10. Accordingly, the core, the coil wire, the number of turns of the coil, and the gap between the core and coil of the inductor 26 are chosen to meet the specific requirements of the ballast circuit 10.

The inductor 26 preferably includes a core made of laminated electrical grade steel. The steel used preferably is rated M-43 grade with a 24 gauge lamination. The coil preferably has 1800 nominal turns of enamel copper wire having a thickness of 32½ AWG (American Wire Gauge). A gap between the core and coil is introduced by means of an electrical grade paper having a thickness of about 12.5 mils (0.0125 inch). This design results in an inductor 26 having an average inductance of 860 mH. The average direct current resistance of the inductor 26 is 70 ohms at an ambient temperature of 22° C. It is noted that the manufacture of this inductor is possible with a minimal copper and core loss and at a reasonable manufacturing cost level.

Electronic starter circuit 24 acts as a momentary switch to provide a suitable starting voltage as well as preheat current to the electrodes 14 and 16. A lead 42 electrically connected to the output terminal of the circuit 24 is also electrically connected to the electrode 16 of the lamp 12. Thus, the electronic starter circuit 24 is coupled across the lamp 12.

Electrically connected between the leads 40 and 42 are three parallel subcircuits. The first subcircuit includes the series connection of a diode 44 and a resistor 46. As illustrated, the diode 44 permits current to flow from the lead 40 to the lead 42 during the positive portion of each cycle of the power source signal to preheat the lamp. Thus, this is also referred to herein as a preheat subcircuit.

The second subcircuit includes a capacitor 48 electrically connected in series with a resistor 50. The capacitor 48 and resistor 50 form a snubber circuit.

The third subcircuit is a switching subcircuit and includes a triac 52 directly electrically connected between leads 40 and 42 and a diac 54 with associated capacitor 56 and associated resistor 58 operatively electrically connected between leads 40 and 42 to provide triggering of the triac 52. A lead 60 extends directly between the diac 54 and triac 52 to provide the triggering current for the triac 52.

Once the input voltage has been placed across the leads 18 and 20, the voltage across the leads 40 and 42 will increase as permitted by the inductor 26. As the voltage across the leads 40 and 42 increases, current flows through the diode 44 and resister 46 every positive half cycle, thereby preheating the filaments 14 and 16 to prepare for the discharge of electricity across the lamp 12. During the negative half of the cycle, the capacitor 56 becomes charged through resistor 58. When the stored charge potential across capacitor 56 reaches the breakdown voltage of the diac 54, the diac 54 is triggered to conduct and, in turn, provides the trigger current to the triac 52 through the lead 60.

Once the triac 52 is triggered, it provides a momentary short between the leads 40 and 42, to thereby provide further necessary heating or ionizing current to the electrodes 14 and 16 as determined by the inductor 26 and the ballasting capacitor 28. The heating or ionizing current is utilized to heat the electrodes 14 and 16, as is known, to ionize gas within the lamp 12.

However, the triac 52 is only "on" for a fraction of a second before it turns off. This occurs because once the triac 52 is triggered on, all of the current through the starter circuit 24 passes through the triac 52. No current charges the capacitor 56 and thus, the diac 54 is no longer triggered. Once the diac 54 is no longer triggered, the triac 52 is no longer triggered.

When the triac 52 opens, the sudden interruption of current through the inductor 26 produces a voltage spike across the lamp 12 thereby striking an arc therein across the electrodes 14 and 16 to light the lamp 12. Once the lamp 12 is lighted, a very low impedance path is provided therethrough, and virtually all of the current through the circuit 10 is transmitted across electrodes 14 and 16 through the arc produced thereacross. Since virtually all of the current through the circuit 10 passes through the lamp 12, the electronic starter circuit 24 is, in effect, removed from the circuit 10. Additionally, because of the relatively short turn-on time of typically 0.4 second, any power factor phase shift is virtually eliminated and the circuit 10 can operate almost indefinitely, i.e., over many cycles greater than 6,000 to 8,000.

Moreover, the ballast circuit 10 enjoys a power factor of at least 90% and greater, a vast improvement over the typical maximum of about 50% of magnetic ballasts and of about 80% in U.S. Pat. No. 5,023,521. To this end, directly electrically connected across the power supply terminals 18 and 20 is a capacitor 70. This capacitor 70 is selected to have a capacitance of 4 $\mu$F±5% at 170 volts A.C. The inclusion of this capacitor 70 enables the ballast system 10 to enjoy high power factor correction, i.e., a power factor of at least about 90%.

In the preferred embodiment, the ballasting capacitor 28 is a capacitor with a 5% tolerance and has a nominal value of 1.0 microfarads. The resistor 30 has a nominal value of 750K ohms. The diode 44 is of the type designated IN4004. The resistor 46 has a value of 47K ohms. The capacitor 48 has a nominal value of 0.022 microfarads. The resistor 50 has a nominal value of 470 ohms. The diac 54 is of the type designated HT-35 (30 V breakdown). The resistor 58 has a nominal value of 560K ohms. The capacitor 56 has a nominal value of about 0.033 microfarads. To ensure that the circuit 10 meets the requirements of the system, the components, with the exception of the ballasting capacitor 28, are chosen to have the above-mentioned characteristics within a 5% tolerance level.

The triac 52 is of the type designated Q401EA typically (1A; 400 V). The triac 52 is specifically selected to have an appreciable gate sensitivity in all quadrants. To that end, the triac 52 is selected so as to have a gate trigger current, of less than 8 milliamps within a 5% range of tolerance. This produces reliable starting of the fluorescent lamp 12.

The ballast circuit 10 is designed primarily to be used to operate F4T5 fluorescent lamps. F4T5 lamps are 4 watt lamps.

The circuit 10 also eliminates the need for a special lamp holder. In previous designs, a lamp normally would require a magnetic ballast including an auto transformer with an output voltage of 220 volts to start the lamp. In accordance with certain standards such as those set forth by Underwriters Laboratories, Inc., the presence of the 220 volt source requires the provision of a special disconnect lamp thereby requiring a holder to avoid electrical shock when changing the lamp. However, with the present circuit design, the voltage level to the lamp leads is reduced to the nominal line voltage of 120 volts, thereby eliminating the need for a special disconnect lamp holder.

Figure 2:
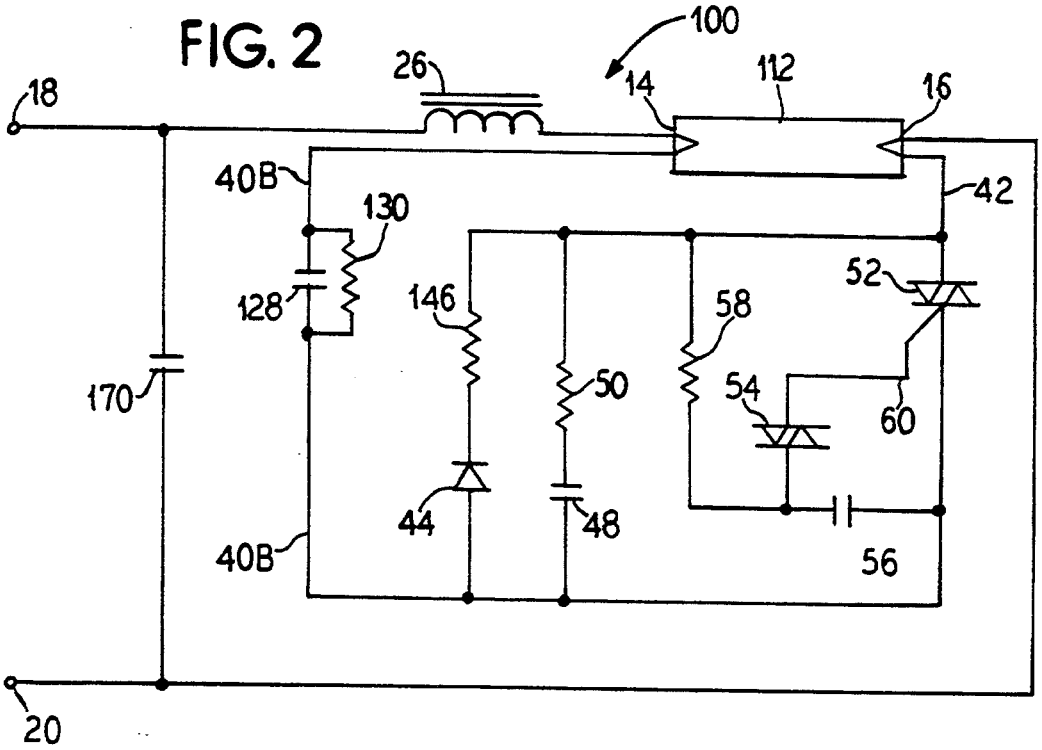
FIG. 2 illustrates a circuit diagram of a second ballasting circuit for fluorescent lamps having high power factor correction.

In FIG. 2 there is illustrated another embodiment of the invention. In FIG. 2 there is illustrated a ballast circuit 100 that for the most part is substantially similar to the circuit 10 of FIG. 1. Accordingly, description of those elements or components of the circuit of FIG. 2 which are similar to those of the circuit 10 of FIG. 1 will not be repeated herein. Like components are designated by the same reference numerals. Instead, those components or elements of the circuit of FIG. 2 that differ from those of the circuit of FIG. 1 are described below.

In this regard, it should be noted that the lamp 112 of concern in the circuit of FIG. 2 is a lamp of the type F8T5, which is an eight-watt lamp. Another difference occurs with respect to capacitor 170 which has a nominal value of 2.8 $\mu$F±10% at 170 volts AC versus the value of 4 $\mu$F for the capacitor 70.

Yet further, the lead 40 electrically connecting the starting circuit to the electrode 14 of the lamp 112, is divided into two sections 40A and 40B between which is positioned a capacitor 128 and a bleeder resistor 130. The ballasting capacitor 128 in FIG. 2 has a value of 0.5 $\mu$F±10%. Finally, the inductor 122 is selected to have a value of 900 millihenrys±10%.

As a first order of approximation, fluorescent lamps can be modelled as resistive loads. The operating voltage for F8T5 lamps is about 46 volts. Thus, when used with an inductive ballast, such as the inductor 126, the resulting power factor would normally be about 50% or less.

In the ballast circuit 100 of FIG. 2, the illustrated configuration also provides a power factor of at least 90% by means of providing the capacitor 170 directly electrically connected across the power supply input and changing the value of ballasting capacitor 28.

Figure 3:
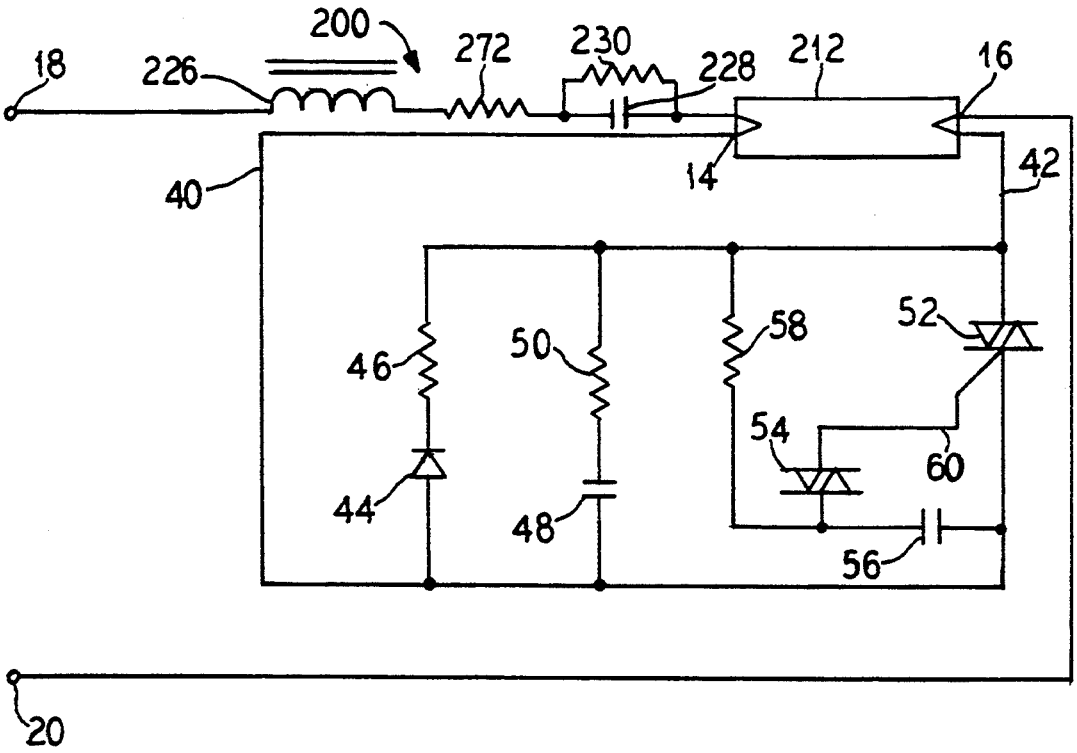
FIG. 3 illustrates a circuit diagram of a third ballasting circuit for fluorescent lamps having high power factor correction.

In FIG. 3 there is illustrated a third embodiment of the invention wherein a ballast of circuit 200 has been configured as to provide a power factor of at least 90% for a lamp 212 comprising an F13T5 type lamp, i.e., a 13-watt lamp. Again, the circuit 200 has many components that are similar to those of the like components of the circuits of FIGS. 1 and 2 and therefore descriptions of these similar components are not repeated herein. However, to the extent there are differences between the circuit of FIG. 3 and the circuits of FIGS. 1 and 2, those differences are discussed below.

In this regard, in FIG. 3, ballasting capacitor 228 with bleeder resistor 230 has been electrically connected in series between an inductor 226 and the electrode 14 of the lamp 212. Additionally, a power factor correcting and ballasting resistor 272 has been electrically connected in series between the inductor 226 and the capacitor 228. Ballasting capacitor 228 preferably has a value of 1.8 $\mu$F±5%. Resistor 272 preferably is a one-watt resistor having a value of 20 ohms±5%, 3 W.

Unlike an F8T5 lamp, an F13T5 lamp has an operating voltage of about 105 volts. Since an F13T5 lamp reacts almost like an resistive load, most of the voltage drop in the circuit occurs across the lamp 212. Accordingly, the power factor initially can be calculated to be about 80%. However, in order to achieve a power factor of 90% or greater, it is necessary to match the inductive reactance very closely with the capacitive reactance of the circuit.

In the circuit illustrated in FIG. 3, the inductor 226 has been configured to resonate with the ballasting capacitor 228. The nominal value of the inductor 226 preferably is about 1.45 henrys±10% and this can be modelled as a resistive element electrically connected in series with a pure inductive element, the modelling resistive element having a value of about 120 ohms.

To achieve these values, the inductor preferably comprises a core size of ½"×⅜" with 2400 turns of 33½ AWG enameled copper wire. In order to reduce core losses, laminated electrical grade steel of grade M-19, 26 gauge or better preferably is employed.

The resistor 272 also reduces excessive heat dissipation in the inductor 226. The resistor 272 also acts as a ballasting element to limit current to the lamp 212.

Although not illustrated, the diac 54 and triac 52 subcircuits could be replaced by any other suitable bilateral voltage triggered switch. For example, a device known as a sidac device manufactured by Shindengen under the designation K1D or equivalent could be substituted for the diac 54 and triac 52 subcircuit.

In contrast to the prior art, the ballast circuits 10, 100 and 200 are less sensitive to line voltage variations and does not allow restriking, i.e., relighting, of the lamps in the presence of low line voltages (i.e., less than 110 volts). The circuits 10, 100 and 200 are designed to perform optimally at lower line voltages such as 105 volts and to absorb voltage increases. Thus, because commercial line voltages vary between about 105–126 volts, the ballast circuit 10 can accommodate and perform well throughout a range of voltages and no variations in light output can be detected.

Restriking, i.e., the phenomenon ever present in glow bulb starters at low voltages typically 105 V which involves the turn off and attempt to restart of a lamp (flickering), is eliminated by virtue of the described circuit designs. The choke components, including the components of the inductors, are chosen so as to not permit voltages to leak through at low line voltages. As a result, the electronic starter circuits do not receive enough voltage so as to react to attempt to start the lamps. Thus, restriking or flickering is eliminated.

While a preferred embodiments have been shown, modifications and changes may become apparent to those skilled in the art which shall fall within the spirit and scope of the invention. It is intended that such modifications and changes be covered by the attached claims.

What is claimed is:

1. A ballast circuit for electrically coupling a fluorescent lamp with electrodes to a power supply, comprising:

a choke electrically connected between the power supply and the lamp;

an electronic starter circuit electrically connected across the lamp;

a ballasting circuit coupled in series between the lamp and the electronic starter circuit, the ballasting circuit comprising a ballasting capacitor and bleeder element coupled in parallel; and means for providing a high power factor electrically connected across the power supply to provide a power factor correction so that in operation, the ballast circuit is characterized by a power factor of at least 90%.

2. The ballast circuit of claim 1, wherein the choke is an inductor.

3. The ballast circuit of claim 1, wherein the means for providing a high power factor is a capacitor.

4. The ballast circuit of claim 1, wherein the electronic starter circuit comprises a triac connected across the lamp, the triac having a trigger input directly connected to a diac that in turn is electrically connected to a capacitance electrically connected to the power supply so that the triac is triggered whenever a sufficient voltage builds up across the capacitor to trigger the diac.

5. The ballast circuit of claim 4, wherein the starter circuit further comprises a snubber circuit electrically connected across the triac and comprising a resistance and capacitance connected in series so that the starter circuit is prevented from latching at the triggering point of the triac.

6. The ballast circuit of claim 1, wherein the choke is an inductor and the starter circuit includes a triac electrically connected across the lamp and means for triggering the triac, so that triggering of the triac places a short circuit across the lamp thereby causing the inductor to place a voltage spike across the lamp to cause arcing across the lamp.

7. The ballast circuit of claim 1 wherein the lamp is a four-watt lamp.

8. The ballast circuit of claim 7 wherein the means for providing a high power factor comprises a 4 μF capacitor.

9. The ballast circuit of claim 1, wherein the lamp is an eight-watt lamp.

10. The ballast circuit of claim 9, wherein the means for providing a high power factor comprises a 2.8 μF capacitor.

11. The ballast circuit of claim 10, including a capacitor electrically connected between the lamp and the power supply, the capacitor and choke being electrically connected to opposite electrodes of the lamp.

12. The ballast circuit of claim 11, wherein the ballasting capacitor and the choke are electrically connected to opposite electrodes of the lamp.

13. The ballast circuit of claim 1 wherein the bleeder element comprises a resistor electrically coupled across the ballasting capacitor.

14. A ballast circuit for electrically coupling to a power supply an eight-watt fluorescent lamp having two electrodes, comprising:

a magnetic choke which is electrically connected between one of the electrodes and the power supply, the magnetic choke including an inductor;

an electronic starter circuit electrically connected across said electrodes;

a ballasting circuit coupled in series between the lamp and the electronic starter circuit, the ballasting circuit comprising a ballasting capacitor and bleeder element coupled in parallel; and a capacitance electrically connected across said power supply to provide a power factor correction so that in operation said ballast circuit is characterized by a power factor of at least 90%.

15. A ballast circuit for electrically coupling to a power supply an eight-watt fluorescent lamp having two electrodes, comprising:

a magnetic choke which is electrically connected between one of the electrodes and the power supply, the magnetic choke including an inductor;

an electronic starter circuit electrically connected across said electrodes, said starter circuit including:

a pre-heater which is electrically connected across said electrodes having a diode and a first resistance connected in series;

a snubber electrically connected across said electrodes including a first capacitance and a second resistance connected in series, and a starter electrically connected across said electrodes including a third resistance and a second capacitance connected in series and a diac having an input terminal electrically connected between said third resistance and said second capacitance, and a triac electrically connected across said electrodes and having a trigger input terminal electrically connected to an output terminal of said diac;

a ballasting circuit coupled in series between the lamp and the electronic starter circuit, the ballasting circuit comprising a ballasting capacitor and bleeder element coupled in parallel; and a power factor correcting capacitance electrically connected across said power supply to provide a power factor correction so that in operation said ballast circuit is characterized by a power factor of at least 90%.

16. A ballast circuit for a fluorescent lamp having electrodes for electrically coupling the lamp to a power supply, comprising:

an inductor electrically connected between the lamp and the power supply;

a starter circuit electrically connected across the electrodes of the lamp and including a triac electrically connected across said electrodes and means for triggering said triac whenever power is applied to said ballast circuit so that said triac directs preheating current through said electrodes, and means for turning off said triac relatively shortly after triggering of said triac and to place a voltage pulse across said electrodes to create an electrical arc across said electrodes;

a ballasting circuit coupled in series between the lamp and the electronic starter circuit, the ballasting circuit comprising a ballasting capacitor and bleeder element coupled in parallel; and a capacitor electrically connected across said power supply to impart a power factor correction so that in operation said ballast circuit is characterized by a power factor of at least 90%.

17. A ballast circuit as set forth in claim 16, wherein said means for triggering said triac includes a diac having an output terminal electrically connected to a trigger input terminal of said triac and having an input terminal electrically connected to a capacitor electrically connected to said power supply.

18. A ballast circuit as set forth in claim 16, wherein said starter circuit further includes a snubber circuit electrically connected across said triac and including a capacitor and resistor connected in series, so that said snubber circuit prevents latching of said starter circuit about a triggering point of said triac.

19. A ballast circuit for a fluorescent lamp having two electrodes for electrically coupling the lamp to a power supply, comprising:

an inductor, a ballasting capacitor and a power factor correcting resistor connected in series between the power supply and one electrode of the lamp and an electronic starter circuit connected across the electrodes of the lamp, the ballast circuit providing a power factor correction that in operation said ballast circuit is characterized by a power factor of at least 90%.

20. The ballast circuit of claim 19, wherein the lamp is a thirteen watt lamp.

21. The ballast circuit of claim 19, wherein the ballasting capacitor has a nominal value of 1.8 $\mu$F and the power factor correcting and ballasting resistor has a nominal value of 20 ohms 5%, 3 W.

22. The ballast circuit of claim 19, wherein the inductor has a nominal value of 1.45 H.

23. The ballast circuit of claim 19, wherein the inductor has a nominal value of 1.45 H., a nominal core size of $\frac{1}{2}'' \times \frac{3}{8}''$ and nominally 2400 turns of $33\frac{1}{2}$ AWG enamelled copper wire.

24. The ballast circuit of claim 23, wherein the inductor further comprises a core made of laminated electrical grade steel having a grade of M-19, 26 gauge or better.

25. The ballast circuit of claim 19, wherein the starter circuit comprises:

a preheat subcircuit electrically connected across the electrodes; and a switching subcircuit electrically connected across the electrodes.

26. The ballast circuit of claim 25, wherein the switching subcircuit comprises:

a triac electrically connected to the lamp, the triac having a trigger input;

a serially electrically connected resistor and capacitor which are electrically connected across the lamp; and a diac having an input terminal electrically connected between the resistor and capacitor and an output terminal electrically connected to the trigger input terminal of the triac.

27. The ballast circuit of claim 26, wherein the starter circuit further comprises a snubber subcircuit electrically connected across the electrodes of the lamp.

* * * * *